US007762715B2

(12) United States Patent
Gordon et al.

(10) Patent No.: US 7,762,715 B2
(45) Date of Patent: Jul. 27, 2010

(54) CAVITATION GENERATOR

(75) Inventors: Roman Gordon, Studio City, CA (US); Igor Gorodnitsky, Marina del Rey, CA (US); Maxim Promtov, Tambov (RU)

(73) Assignee: Cavitation Technologies, Inc., Chatsworth, CA (US)

( * ) Notice: Subject to any disclaimer, the term of this patent is extended or adjusted under 35 U.S.C. 154(b) by 0 days.

(21) Appl. No.: 12/395,110

(22) Filed: Feb. 27, 2009

(65) Prior Publication Data

US 2010/0103768 A1 Apr. 29, 2010

Related U.S. Application Data

(60) Provisional application No. 61/108,726, filed on Oct. 27, 2008.

(51) Int. Cl.
*B01F 5/06* (2006.01)

(52) U.S. Cl. ..... 366/176.1; 366/340; 138/40

(58) Field of Classification Search ..... 366/162.4, 366/181.5, 174.1, 175.2, 176.1–176.4, 336–340; 138/40; 516/928–931; 137/896
See application file for complete search history.

(56) References Cited

U.S. PATENT DOCUMENTS 1,454,196 A * 5/1923 Trood ..... 48/189.4
1,626,487 A * 4/1927 Warren ..... 366/163.2
3,167,305 A * 1/1965 Backx et al. ..... 366/338
4,014,961 A 3/1977 Popov
4,213,712 A * 7/1980 Aanonsen et al. ..... 366/168.2
5,302,325 A * 4/1994 Cheng ..... 261/76
5,492,654 A 2/1996 Kozjuk et al.
5,937,906 A * 8/1999 Kozyuk ..... 138/37
5,969,207 A * 10/1999 Kozyuk ..... 422/127
5,971,601 A 10/1999 Kozyuk
6,200,486 B1 3/2001 Chahine et al.
6,227,694 B1 5/2001 Mitake et al.
6,276,823 B1 * 8/2001 King ..... 366/181.5
6,502,979 B1 1/2003 Kozyuk
6,705,396 B1 3/2004 Ivannikov et al.

(Continued)

FOREIGN PATENT DOCUMENTS

DE 77 33 456 U1 5/1978

(Continued)

OTHER PUBLICATIONS

K. Mahesh, G. Constantinescu, P. Moin; A numerical method for large-eddy simulation in complex geometries; Journal of Computational Physics; Nov. 19, 2003; pp. 215-240; vol. 197; Elsevier Inc.

(Continued)

*Primary Examiner*—Charles E Cooley
(74) *Attorney, Agent, or Firm*—Kelly Lowry & Kelley, LLP

(57) ABSTRACT

A method and device are provided for mixing and manipulating fluids in a multi-stage flow-through hydrodynamic cavitation system. The system comprises a cylindrical device having a flowpath with a multi-jet nozzle, spiral guides, a vortex generator and an atomizing cone disposed sequentially therein to induce cavitational features in a fluidic mixture. The sequential elements are designed to induce and dissipate the cavitational features in a multi-stage treatment process.

12 Claims, 3 Drawing Sheets

U.S. PATENT DOCUMENTS

| | | | | |
|---|---|---|---|---|
| 6,935,770 | B2 * | 8/2005 | Schueler | 366/174.1 |
| 6,979,757 | B2 | 12/2005 | Powers | |
| 7,207,712 | B2 | 4/2007 | Kozyuk | |
| 7,247,244 | B2 | 7/2007 | Kozyuk | |
| 7,338,551 | B2 | 3/2008 | Kozyuk | |
| 2005/0237855 | A1 | 10/2005 | Kozyuk | |
| 2007/0041266 | A1 * | 2/2007 | Huymann | 366/162.4 |
| 2007/0189114 | A1 * | 8/2007 | Reiner et al. | 366/176.2 |
| 2009/0141585 | A1 * | 6/2009 | Al-Otaibi | 366/339 |

FOREIGN PATENT DOCUMENTS

| | | | |
|---|---|---|---|
| DE | 10310442 | A1 * | 9/2004 |
| JP | 62-221426 | A2 | 9/1987 |
| LV | 12900 | B | 2/2003 |
| RU | 1790438 | A3 * | 1/1993 |
| SU | 633576 | * | 11/1978 |

OTHER PUBLICATIONS

Xiangbin Li, Guoyu Wang, Mindi Zhang, Wei Shyy; Structures of supercavitating multiphase flows; International Journal of Therman Sciences; Nov. 24, 2007; pp. 1263-1275; vol. 47; Elsevier Masson SAS.

FlowMaxx Engineering, Cavitating Venturis, web article, 1 page, www.flowmaxx.com/cavitate.htm, USA, Mar. 2010.

FlowMaxx Engineering, Venturi Flowmeters, web article, 5 pages, www.flowmaxx.com/cavitate.htm, USA Mar. 2010.

* cited by examiner

CAVITATION GENERATOR

BACKGROUND OF THE INVENTION

The present invention relates generally to mixers and cavitation devices that are used for processing heterogeneous and homogeneous fluids by the controllable formation of cavitation bubbles. Each cavitation bubble serves as an independent mini-reactor, and uses the energy released upon implosion of the bubble to quickly alter the fluids. The device finds application in chemical, pharmaceutical, fuel, food and other industries to prepare solutions, emulsions, and dispersions, and to improve mass and heat transfer processes.

More particularly, the present invention relates to the modification of complex fluids composed of many individual compounds and utilizes cavity implosion energy to improve the homogeny, viscosity, and/or other physical characteristics of the fluids by altering their chemical composition and converting compounds to obtain upgraded, more useful products.

It has been reported that elevated pressure and increased temperature and vigorous mixing supplied by either acoustic or hydrodynamic cavitation initiate and accelerate numerous reactions and processes. Enhancing the reaction and processes by means of the energy released upon the collapse of cavities in the flow has found application in a number of technologies that are used for upgrading, mixing, pumping, and expediting chemical conversions. While extreme pressure or tremendous heat can be detrimental, expensive and mechanically cumbersome the outcome of such controlled treatments is often highly beneficial.

Cavitation can be created in many different ways such as, for example, hydrodynamic, acoustic, laser-induced or generated by direct injection of steam into a sub-cooled fluid, which produces collapse conditions similar to those of hydrodynamic and acoustic cavitations (Young, 1999; Gogate, 2008; Mahulkar et al., 2008). The direct steam injection cavitation coupled with the acoustic cavitation exhibits up to 16 times greater efficiency as compared to acoustic cavitation alone.

The formation of bubbles in fluid is noticeable, when its temperature approaches the boiling point. If fluid is irradiated with ultrasound waves or processed in a hydrodynamic cavitation reactor with suitable velocity, the cavitation bubbles will form at a concentration of hundreds per milliliter. Their formation can be suppressed by increasing the pressure. The bubbles take up space normally occupied by fluid resisting the flow and increasing the pressure. If the cavitation bubbles relocate into a slow-velocity, high-pressure zone (reversed Bernoulli's principle), they will implode within $10^{-8}$-$10^{-6}$ s. The implosion is accompanied by a sharp, localized elevation in both pressure and temperature, as much as 1,000 atm and 5,000° C. Such elevations in pressure and temperature result in the generation of local jet streams with 100 m/s velocities and higher (Suslick, 1989; Didenko et al., 1999; Suslick et al., 1999; Young, 1999).

The collapse of cavities is accompanied by shock waves, vigorous shearing forces, and a release of significant amounts of energy, which activates atoms, molecules and radicals located within the gas-phase bubbles and the atoms, molecules and radicals in the surrounding fluid. The release of energies accompanying the collapse initiates chemical reactions and processes and/or dissipates into the surrounding fluid. In many cases, the implosion is emission-free. Often it is followed by the emission of ultraviolet and/or visible light, which may induce photochemical reactions and generate radicals (Zhang et al., 2008). One disadvantage of extremely high pressure is extreme heat generation, which may become important if overheating is detrimental to product quality and safety.

The cavitation phenomenon is categorized by the dimensionless cavitation number $C_v$, which is defined as: $C_v=(P-P_v)/0.5\rho V^2$, where P is the recovered pressure downstream of the constriction, $P_v$ is the vapor pressure of fluid, V is an average velocity of fluid at the orifice, and ρ is its density. The cavitation number at which cavitation begins is the cavitation inception number, $C_{vi}$. Cavitation ideally begins at $C_{vi}=1$, and a $C_v<1$ indicates a higher degree of cavitation (Gogate, 2008; Passandideh-Fard and Roohi, 2008). Another important term is the processing ratio, which corresponds to a number of cavitation events in a unit of flow. The effect of surface tension and size of cavities on the hydrostatic pressure is defined as follows: $P_i=P_o+2a/R$, where $P_i$ is the hydrostatic pressure, a is the surface tension, and R is the radius of the bubble. The smaller the bubble, the greater the energy released during its implosion.

Cavitation is more dramatic in viscous fluids. If, for example, oil moves at a high speed causing its pressure to drop below the vapor pressure of some hydrocarbon constituents, cavitation will occur. The cavitation separates the liquid-phase, high-boiling-point compounds and their particles suspended in liquid compounds from the entrapped gases, water vapor and vapors of the affected compounds. Small particulates and impurities serve as nuclei for the cavitation bubbles that may reach a few millimeters in diameter, depending on conditions.

Cavitation generated by sound waves in the sonic (20 Hz-20 KHz) or in the ultrasonic (>20 KHz) ranges does not offer an optimized method. The disadvantage of such methodology is its batch environment. Such methodology cannot be used efficiently in a continuous process, because the energy density and the residence time would be insufficient for high throughput. For instance, the intensity threshold of ultrasound cavitation in water is higher than 0.3 W/cm$^2$. The sound wave cavitation technology suffers from other drawbacks as well. Since cavitation effect diminishes with an increase in distance from the radiation source, the treatment efficacy depends upon container size, i.e., lower efficacy with larger vessels. In addition, alterations in fluid are not uniform and can occur at certain high intensity locations, depending on the frequency and interference patterns of the sound waves.

Hydrodynamic cavitation does not require the use of a specific type of container as does sound or ultrasound-induced cavitation. Numerous flow-through hydrodynamic devices are known. See, for example, U.S. Pat. No. 6,705,396 to Ivannikov et al., and U.S. Pat. Nos. 7,207,712, 6,502,979 and 5,971,601 (Kozyuk), which describe different hydrodynamic cavitation reactors and their usage.

U.S. Pat. No. 7,338,551 to Kozyuk discloses a device and method for generating bubbles in a fluid that passes through a first local constriction of hydrodynamic cavitation device at a velocity of at least 12 m/s and then is mixed with gas to enhance implosion within the second cavitation field. Although, this device provides two cavitation zones, its efficiency is not satisfactory when a higher number of the consecutive cavitations is desired.

Another approach illustrated in the U.S. Pat. No. 5,969,207 to Kozyuk uses a flow-through passage accommodating a baffle body that generates a hydrodynamic cavitation with cavitation number (Cv) of at least 1 to initiate chemical transformations and to change the qualitative and quantitative composition of liquid hydrocarbons.

Russian Pat. No. 2143312, B 01 J 10/00 describes a gas-liquid system comprised of a vortex cavitation device surrounded by a vertical cylindrical housing. The cavitation device is positioned in the middle section of this housing and is equipped with both mixing and foam chambers coupled via a constricting nozzle. The feeding tube is coaxially aligned with the mixing chamber and functions as a cavitating nozzle with a conical splitter. In order to produce the swirl flow, the feeding tube has eight square threads with the openings separated by a 2-5 mm distance. The main disadvantages of this device are manufacturing complexity and high resistance to flow due to the swirling element.

Yet another Russian Pat. No. 2126117, F 24 J 3/00 discloses a heating cavitation device comprising a cylindrical housing, a Venturi-type nozzle and a baffle body, which is placed inside it. The Venturi-type nozzle houses a rotating impeller positioned in front of the baffle body along the flow. The outer surface of the baffle body has longitudinal slots that are amenable to the impeller and are coupled to the other end of the baffle body with the holes. The major drawback of said device is its manufacturing cost. Moreover, the impeller is prone to jamming, which decreases the treatment efficiency.

The patent of Russia No. 2158627, B 01 J 5/08 introduces a cavitation mixer comprising a cylindrical working chamber, a fluid feeding nozzle shaped as a convergent cone and a cone nozzle for discharging the atomized fluid. The chamber inlet houses a multi-jet nozzle for fluid mixing, which is followed by a nozzle for an optional introduction of additional components. The working chamber has a circular threshold-shaped runner attached to its interior. The inner surface of the chamber's rear end comprises the radial longitudinal ribs. This device is not capable of generating a uniform cavitation field within the chamber, and, as a result, the efficiency of processing is insufficient.

At the present time, with the cost of energy rising rapidly, it is highly desirable to shorten processing time and lower energy consumption to secure as large a profit margin as possible. The prior art techniques do not offer the most efficient method of upgrading fluids, especially complex mixtures and non-Newtonian viscous liquids in the shortest amount of time possible.

Therefore, need exists for an advanced flow-through device for mixture processing with a minimal treatment time and energy cost resulting in products with improved characteristics that can be easier to handle. The advanced, compact, and highly efficient device is particularly desired at the mining locations and refineries, where throughput is a key factor. The present invention provides such a device while delivering upgraded products within a short time.

SUMMARY OF THE INVENTION

The present invention provides a method and device for generating multi-stage cavitation in fluid flow within at least three consecutive cavitation chambers. This goal is achieved through the design of the multi-stage cavitation device aimed for fast modification of complex fluids. In accordance with the present invention, the method comprises feeding a fluid in the flow-through hydrodynamic multi-chamber cavitation device using a controlled inlet pressure sustained by a pump and applying selected reagents and conditions.

The present invention is directed to a method for processing a fluidic mixture in a multi-stage hydrodynamic cavitation device. The method begins with providing a flowpath through the hydrodynamic cavitation device. Next, the fluidic mixture is pumped through a multi-jet nozzle having a plurality of channels. The multi-jet nozzle creates cavitation features in the fluidic mixture. The fluidic mixture is then passed over a plurality of spiral guides disposed in a working chamber. The spiral guides also create cavitation features in the fluidic mixture. The fluidic mixture is next conveyed over a plurality of flow guides in a vortex chamber. The flow guides and vortex chamber create cavitational features in the fluidic mixture. Finally, the fluidic mixture is introduced into an atomizing cone having an increasing cross-sectional area. The fluidic mixture loses all cavitational features in the atomizing cone.

The working chamber is bounded by the outer wall of a guide cone and the inner wall of a convergent cone. The guide cone and convergent cone are arranged coaxially along the flowpath such that the working chamber follows the facing inner and outer walls of the respective cones. The spiral guides are arranged about the outer wall of the guide cone and have a decreasing pitch following the decreasing diameter of the working chamber. The spiral guides run from the multi-jet nozzle to the peak of the guide cone.

The multi-jet nozzle preferably includes four channels. Each of said channels have abrupt contractions and expansions along the flowpath. The channels may be venturi-type channels having a conical inlet with a round profile, a cylindrical throat, and a conical outlet.

The fluidic mixture may be processed multiple times. This may be achieved either by multiple passages through a single multi-stage hydrodynamic cavitation device or passage through multiple multi-stage hydrodynamic cavitation devices arranged in series.

The multi-stage hydrodynamic cavitation device for processing a fluidic mixture comprises a cylindrical housing having a flowpath therethrough and an inlet cone disposed in an inlet to the flowpath. A multi-jet nozzle is positioned in the flowpath after the inlet cone. The multi-jet nozzle has a plurality of channels disposed around a perimeter ring of the multi-jet nozzle.

A working chamber having a generally annular-conical shape with a decreasing diameter is positioned in the flowpath after the multi-jet nozzle. A plurality of spiral guides are disposed in the working chamber running from the channels on the multi-jet nozzle through the working chamber.

A vortex generator follows the working chamber along the flowpath. The vortex generator is comprised of a front disk, a rear disk and a cylinder body disposed therebetween. The front and rear disks include curved flow guides running from a central hole to an annular gap surrounding the cylinder body. An atomizing cone follows the vortex chamber along the flowpath.

The multi-jet nozzle preferably has four channels, each channel having an abrupt contraction and an abrupt expansion along the flowpath. Alternatively, each channel may be a venturi-type channel comprised of a conical inlet having a round profile, a cylindrical throat and a conical outlet.

The generally annular-conical shape of the working chamber is defined by an outer wall of a guide cone and an inner wall of a convergent cone arranged coaxially along the flowpath with the guide cone. The spiral guides are arranged around the outer wall of the guide cone and have a decreasing pitch following the decreasing diameter of the working chamber toward a peak of the guide cone. The number of spiral guides preferably equals the number of channels in the multi-jet nozzle.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
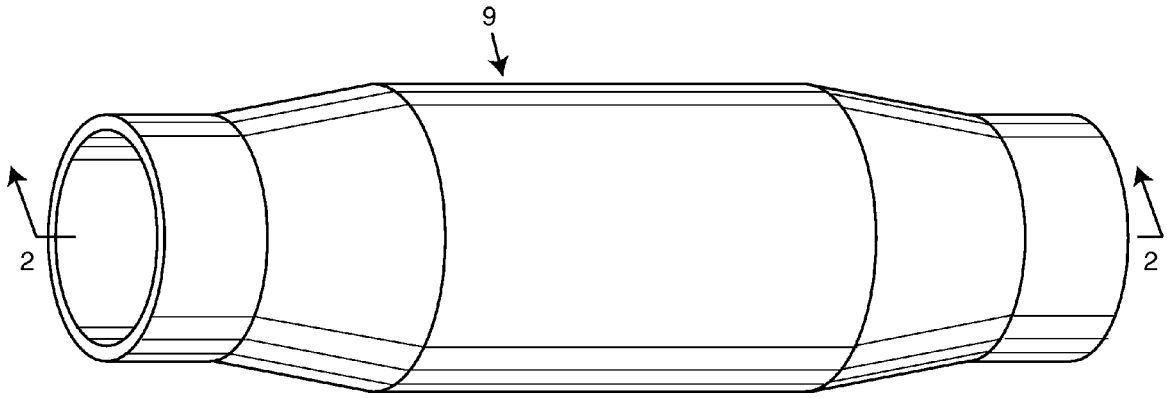
FIG. 1 is a diagram depicting a preferred embodiment of the inventive multi-stage cavitation device.

The present invention is directed to a method of generating micro bubbles in a fluid resulting in the alteration of the physical and/or chemical properties of said fluid. The fluid is pumped into a flow-through hydrodynamic multi-stage cavitation reactor, controlling cavitation intensity by varying the inlet pump pressure, and continuing the application of such cavitation for a period of time sufficient to alter said fluid and obtain the upgraded product. The term fluid includes, but is not limited to homogeneous or heterogeneous complex mixtures, fluids existing in a liquid phase immediately prior to cavitation, a two-phase or multi-phase system comprised of hydrocarbons, oil, water and/or any other unmixable liquids, solutions of salts, gases and/or other solutes, dispersions, emulsions, suspensions, melted solids, gases in supercritical conditions and mixtures thereof. The fluid may be degassed or mixed with hydrogen, nitrogen, carbon dioxide, other gasses or mixtures thereof. The flow-through hydrodynamic cavitation system is especially suitable for processing complex viscous mixtures of various origin such as, for example, conventional or non-conventional oil, cell extracts, fruit pulp and etc.

Accordingly, besides the objects and advantages of the expeditious complex fluid upgrading described above, several objects and advantages of the present inventions are:

(1) to ease operation, improve productivity and reduce energy consumption of fluid processing;

(2) to provide a continuous flow device for upgrading oil in a dramatically expedited manner with optimized energy costs;

(3) to provide a method for mixing and altering fluids by subjecting them to at least three consecutive hydrodynamic cavitation operations at gradually increasing temperature by decreasing the cavitation threshold;

(4) to provide a method for the gradual, cascade-type alteration of fluids by subjecting the original constituents of said fluids to a first cavitation event followed by subjecting the residual original compounds and products of the reactions to subsequent cavitation events.

(5) to provide a device for manipulating fluids at the site of production;

(6) to provide a method for altering oil to obtain changes resembling cracking without the systemic high temperatures and pressures associated with cracking;

(7) to produce a uniform cavitation field throughout a fluid volume for a time sufficient to synthesize new stable molecules and produce other changes;

(8) to provide a method, wherein two or more a flow-through hydrodynamic multi-stage cavitation systems can be employed.

The objects of the present invention are achieved by forcing fluids into the flow-through hydrodynamic cavitation apparatus to induce chemical reactions and/or change physical properties of fluids. Hydrodynamic cavitation assumes formation of vapor bubbles within a fluid accelerated to a high velocity. In practice, fluid is accelerated with a high-pressure pump. The phenomenon is named cavitation, because cavities form when the fluid pressure has been reduced to its vapor pressure. The vapor bubbles expand as they move and suddenly collapse, creating a region of high pressure. The violent collapse causes tremendous localized increases in pressure and temperature and intense shearing forces, resulting in chemical reactions. By subjecting the fluid to flow-through hydrodynamic cavitation, molecules are activated and are converted into new stable components.

It becomes an equipment cost decision what type of a flow-through hydrodynamic cavitation device configuration to use since a number of approaches are technically feasible, whether for large scale upgrading or treatment of small volumes. One method for ensuring the best conditions is to create cavitation evenly throughout the flow avoiding wasting energy. Ideally, the energy applied should be lowered to an optimized level when cavitation still efficiently occurs and energy expenditure is minimal.

With reference to the attached drawings, FIGS. 1-6, a method and device for the creation of cavitation processes in fluid flows resulting in localized regions of increased pressure, heat and vigorous mixing to generate changes in fluids are disclosed. The method and device include the use of a flow-through hydrodynamic multi-stage cavitation reactor to promote chemical and physical processes and reactions that occur in a short time and results in well-mixed upgraded products. Intense localized heat released because of gas compression and microjet formation, which accompany the implosion of cavitation bubbles, excite molecules contained in vapors and in the adjacent layers of surrounding fluid transiently enriched with the high-point-boiling ingredient (s), thereby driving various chemical reactions and processes.

Figure 2:
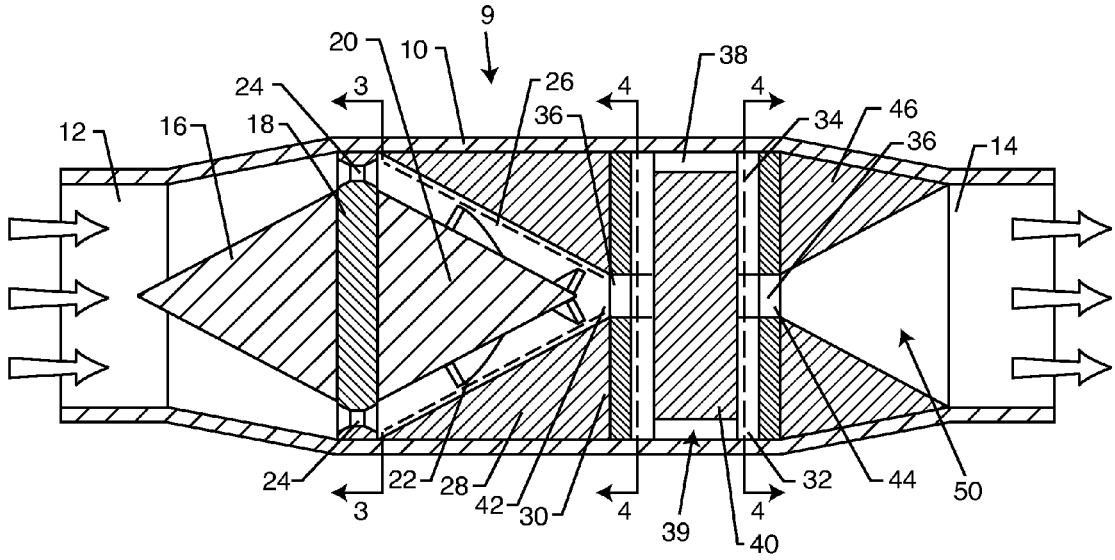
FIG. 2 is a cross-sectional view of the multi-stage cavitation device taken along line 2-2 of FIG. 1.

A preferred embodiment of the multi-stage cavitation device of the present invention is illustrated in FIGS. 1 and 2, which depict a hydrodynamic flow-through multi-stage cavitation system capable of achieving the objects of the present invention. Said system comprises a housing defining a substantially cylindrical exterior, a fluid inlet in said housing, a working chamber, a fluid outlet in the working chamber positioned for withdrawal of fluid from the chamber, an exit from the vortex chamber, and an atomizing cone aligned coaxially with the upstream compartments. The fluid inlet is positioned to introduce fluid into the upstream multi-jet nozzle housing channels having abrupt contractions and expansions. The working chamber is a key part of the system and is shaped as a convergent cone. The working chamber houses flow guiding elements and is where the first cavitation event takes place. The fluid outlet accelerates and directs the fluid into a vortex chamber where the second cavitation event occurs. The bubble-enriched fluid exiting in the atomizer is subjected to the third cavitation treatment.

Figure 3:
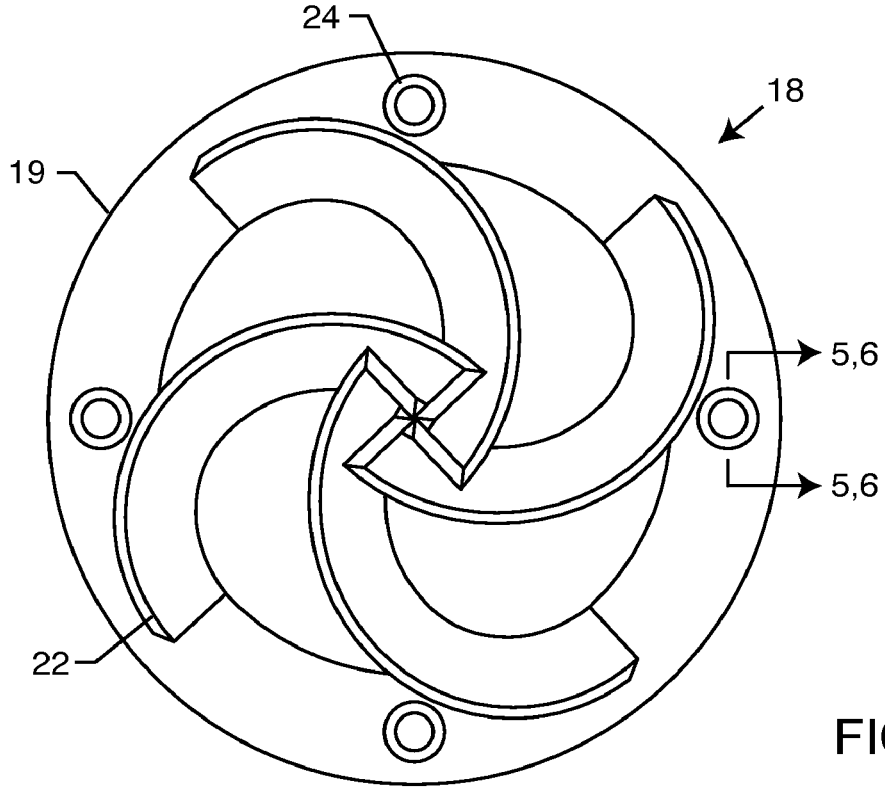
FIG. 3 is a cross-sectional view of the front end of the working chamber of the cavitation system taken along line 3-3 in FIG. 2.

The cavitation device as shown in FIGS. 1 and 2 is comprised of a cylindrical body 10 made preferably of a metal, an inlet tube 12 and an outlet tube 14. An inlet cone 16 is located in front of a multi-jet nozzle 18 along the flow path. A guide cone 20 is positioned behind the nozzle 18 and features spiral guides 22. The multi-jet nozzle 18 is shaped as a disk having a perimeter ring 19 and features four channels 24 that have both across abrupt contractions and expansions (FIGS. 2 and 3). The number of spiral guides 22 is equal to the number of channels 24 in the multi-jet nozzle 18. The channels 24 are uniformly distributed throughout the surface area of the multi-jet nozzle 18 and direct flow along the working chamber 26.

The working chamber 26 is located behind the multi-jet nozzle 18 along the flow path and has an inner wall formed by the cone 20 and an outer wall formed by a convergent cone 28. The convergent cone 28 is aligned coaxially with the guide cone 20. An outlet 42 from the convergent cone 28 leads to a vortex generator 29.

Figure 4:
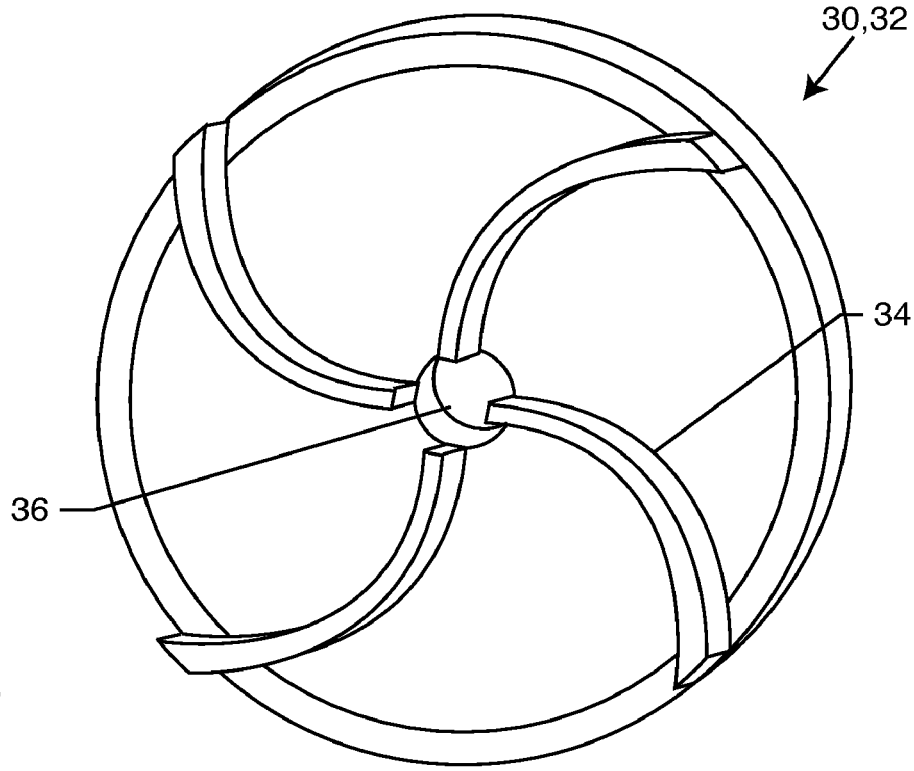
FIG. 4 is a cross-sectional view of the vortex element taken along lines 4-4 in FIG. 2.

Behind the convergent cone 28 is the vortex chamber or generator 29 comprised of disks 30, 32 with curved flow guides 34 and central holes 36 that are coaxially aligned (FIG. 4). An annular gap 38 is located between the front and rear disks 30, 32 and around a cylinder-type body 40 of slightly smaller diameter than the vortex chamber 29, that blocks the direct path of the jet emerging from the central hole 36 in the front disk 30. The curved flow guides 34 are raised with respect to the disks 30, 32 so as to extend out to the cylinder type body 40.

The flow guides 34 create multiple curved flow paths from the central hole 36 in the front disk 30 to the annular gap 38 of the vortex generator 39. Similar paths are created from the annular gap 38 of the vortex chamber 39 to the central hole 36 on the rear disk 32 on the backside of the cylinder-type body 40. The central holes 36, the outlet 42 of the convergent cone 28 and an inlet 44 of the atomizing cone 46, which is situated behind the vortex generator 29 along the flow path, all have the same diameters.

The inventive cavitation device 9 can be fabricated from many materials, although there are some constraints placed on them. The materials should be simple in fabricating and brazing, be able to withstand both high pressure and high temperature, and exhibit high resistance to corrosion, thus allowing the system to be operated continuously and/or repeatedly with a variety of fluids. The materials should be mechanically compartible to assure similar properties of material extension upon heating. A coating with plastics is possible. In one preferred embodiment of the invention, the device is made from a hardened stainless steel. The inner surfaces may be coated with solid catalysts, preferably metal oxides.

Both the inner and outer system dimensions depend upon the intended use of the device. A small cavitation system is preferable when the amount of fluid to be cavitated is limited or its cost is too high. A large system with an inner diameter of 10 inches or greater provides a high treatment throughput and generates larger cavitation features. In the preferred embodiment, the cavitation device 9 is about 14 inches long with an outside diameter of about 3 inches.

Figure 5:
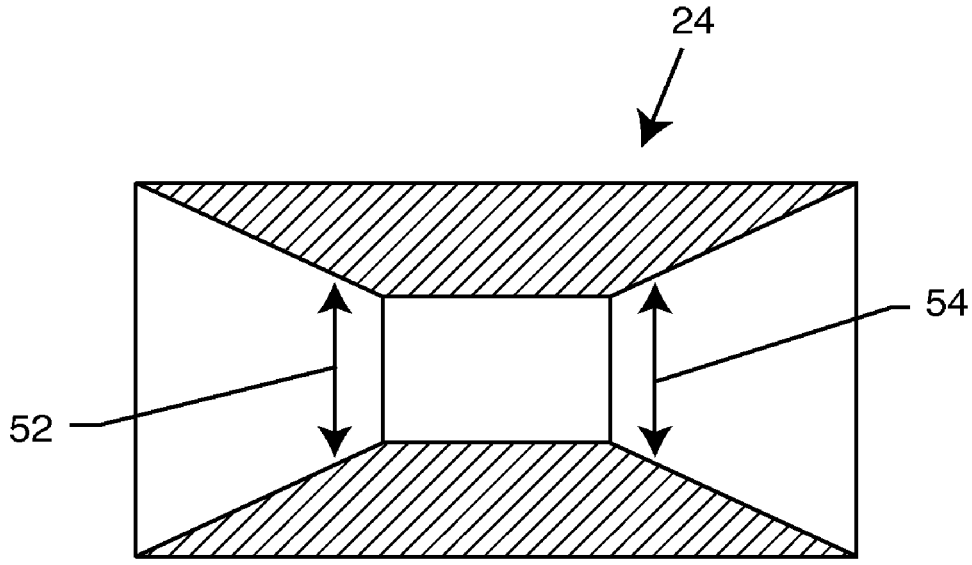
FIG. 5 is a cross-sectional view of one embodiment of a channel in a multi-jet nozzle taken along line 5-5 in FIG. 3.

The present cavitation system provides at least three major cavitation zones and operates as follows. Presumably sufficient fluid, for example, a roughly dispersed emulsion, is initially pressurized with a proper pressure pump and introduced through the inlet 12 which has a uniform outside diameter of 1.5 inches in the preferred embodiment. The fluid enters at the top of the inlet cone 16, which is surrounded by the inner peripheral wall of the housing 10. The fluid accelerates over the inlet cone 16 and moves into the channels 24 of the multi-jet nozzle 18. To enhance mixing and cavitation, the channels 24 of the multi-jet nozzle 18 are uniquely shaped and contain both contractions 52 and expansions 54. More particularly, the cross-sectional diameters of the channels 24 vary along the fluid path, as illustrated in FIG. 5.

Figure 6:
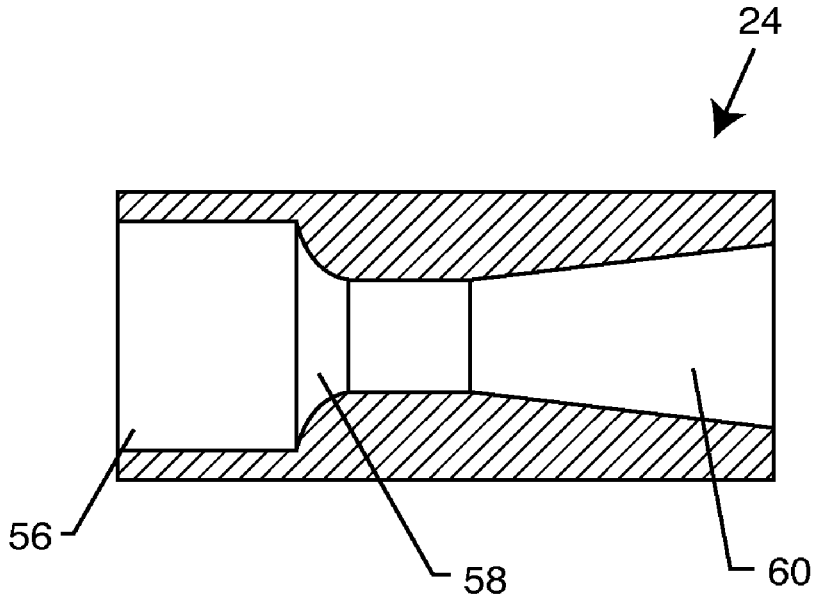
FIG. 6 is a cross-sectional view of an alternative embodiment of a channel in a multi-jet nozzle taken along line 6-6 in FIG. 3.

As illustrated in FIG. 6, the channels 24 can alternately be fabricated as Venturi-type nozzles to separate vortices and generate pressure pulsations at characteristic frequencies. A Venturi-type nozzle is defined as a throttle device comprised of a conical inlet 56 with a round profile, a cylindrical throat 58 and a conical outlet (diffusor) 60. The Venturi nozzle generates unsteady flow that can be calculated (Fedotkin and Gulyi, 2000; Mahesh et al., 2004; Li et al., 2008).

When fluid moves through the channels 24, the vortices, completely detached jets and possible cavitation are produced. They act upon the fluid by altering emulsion homogeny, improving the degree of dispersion, and modifying the particle surfaces. The streams exiting adjacent channels 24 are mixed by passing through the narrow gaps formed by the spiral guides 22 mounted between the second cone 20 and the walls of the convergent cone 28, and flowing through the working chamber 26.

Although this configuration is preferred, it should be understood that the spiral guides 22 do not have to be mounted at a specific angle or at a specific location relative to the channels 24 in order to generate cavitation within working chamber 26. The preferred configuration of the guides 22 has a gradual decrease in the pitch of the spiral toward the peak of the guide cone 20 in order to accelerate the flow velocity. This allows the fluid to form patterns and jets in the flow and form vortices and shear when the flow's upper layers separate from those lying underneath because of the substantial difference in the velocities.

The fluid directed by the guides 22 exhibits significant cavitation within the working chamber 26. Implosion of the generated cavitaties results in the formation of shock waves, high-velocity local jets and heat dissipation, improving both reaction rates and mass transfer. The jet velocities and intensity of the vortices and cavitation depend on the interaction of a fluid-vapor mixture with vapor. As the cavitation number decreases, fluctuating cavities with periodic vortex shedding, fluid-vapor filled cavities within a turbulent wake, and cavities filled with vapor are observed. In the cavitation region, strong momentum transfer between the higher and lower flow layers occurs. In the core zone of the region, the flow velocity is high and evenly distributed. The low velocity region lessens as the flow path moves downstream. The cavitation bubble dimensions and the intensity of the cavitation field increase as the fluid moves toward the middle part of the working chamber 26. An increase in the difference in flow pressures favors cavitation and vortex formation.

The cross-sectional area of the working chamber 26 decreases along the flow path due to the decrease in diameter of the guide cone 20, and the corresponding diameter of the convergent cone 28, resulting in acceleration of the fluid flow. With the increase in velocity the fluid pressure drops, favoring conditions suitable for cavitation. Moreover, upon exiting the working chamber 26, the fluid is further accelerated by sliding over the spiral guides 22. The fluid then passes through the central hole 36 in the front disk 30, enters the flow guides 34, passes to the annular gap 38, and then follows the flow guides 34 of the rear disk 32 to the central hole 36. The drastic increase in the cross-sectional area of the flow path, sharp changes of the flow direction and vigorous vortex formation promote nucleation, growth and coalescence of cavitational features. In the vortex chamber 39, the cavitation bubbles are subjected to the increased pressure caused by flow dynamics, i.e., apparent centrifugal and Coriolis forces. Consequently, the bubbles implode at a higher flow velocity than normal.

Exiting the vortex chamber 38, the fluid, which has been heated by the cavitation process, enters the channels formed by the guides 34 and accelerates due to the narrowing cross-sectional area. When fluid moves along the curved channels, it causes rolling friction, which requires much less force to overcome than sliding friction. The flow guides 34 of the disks 30, 32 of the vortex generator 39 are shaped as curved arcs of circles in order to reduce the energy required to direct fluid in the vortex generator 39. The energy required to force flow along the convex section of the curved guides 34 is much less. The force required for overcoming the rolling friction on the concave section of the guides 34 depends on their curvature.

The vortex flow exits the central hole 36 in the rear disk 32 and atomizes within the cone 46. The drastic increase in cross-sectional area, sharp alterations of the flow direction and its vortex nature promote formation and expansion of cavitational features, and other effects. In the outlet 14 from the atomizer 50, the flow rate drops with minimal energy loss until it reaches the level acceptable by the downstream pipe line safety requirements. As the hydrostatic pressure rises, the cavitation bubbles quickly collapse and the negative impact of cavitation on the downstream pipe line and equipment promptly disappear. The flow-through cavitation process may be coupled with ultraviolet and/or visible light treatments to improve efficiency. The fluid may also be irradiated with sound or ultrasound waves prior to and/or after the flow-through cavitation.

The present multi-stage cavitation device provides at least three zones where vigorous vortex formation and intense cavitation occur. The first cavitation zone is within the working chamber 26, the second cavitation zone is in the vortex generator 39, and the third cavitation zone is in the atomizing cone 46. This configuration is particularly cost efficient in a large volume treatment. However, the same principles can be applied to any alteration at smaller scale. Note, that ultrasonic radiation generating devices are not sufficient to induce uniform cavitation in large vessels.

In the case of a cavitation treatment of a multi-component fluid, the composition of cavitation bubble is not uniform. The bubbles contain vapors of the compounds that are volatile under the given conditions. The bubble implosion releases energy that drives chemical reactions and/or heats the fluid. The processed mixture contains the products of these reactions, i.e., the newly formed stable compounds. The size of cavities depends on the nature of the fluid under treatment, the engineering design of the cavitation device and other conditions, such as the velocity of flow sustained by the pump. The pump pressure may be increased until a proper intensity of cavitation is achieved. In addition to determining the size, concentration and composition of the bubbles, and, as a consequence, the amount of energy released, the inlet pressure governs the reactions of the constituents.

The faster the flow rate, the lower the cavitation number. A lower cavitation number (especially cavitation numbers less than 1) implies a high degree of cavitation. The preferred embodiment of the present invention optimizes the cavitation to perform even fluid alterations by applying the most suitable pump pressure selected from a range of 50-5,000 psi. If too much energy is applied or the treatment time is too long, then the cost of upgrading goes up. By applying hydrodynamic cavitation at a pump pressure designed to cause cavitation and chemical conversion consistently throughout the fluid, property changes take place and a desirable outcome is produced.

The device 9 schematically presented in FIGS. 1-6 is used for carrying out the method, according to the present invention. In accordance with the present invention, fluid is treated either continuously or periodically, by passing through the multi-stage cavitation device 9. The apparatus can be placed anywhere in a production site, refining column or any other body. Another design exists in which the device 9 may be fixed in position or movable. In addition, multiple devices 9 may be combined in a series or parallel configuration. In practice, it is necessary to take into account the cost of the device 9, its production capacity and the subsequent energy, maintenance and operation cost. It should be emphasized, that an operator of the cavitation device 9 is not required to wear the high performance safety products for hearing protection, such as earmuffs or earplugs, as it would be in the case of high frequency cavitation.

The occurrence of cavitation bubble implosion is accompanied by the formation of numerous deformed micro bubbles. Pressure and temperature of vapors contained in these bubbles are very high. If fluid enriched with these bubbles moves into the reduced pressure zone, they will become nuclei, which are less stable than those originally present in the fluid, and expand. The cavitation bubbles developed from these nuclei enhance the cavitation field intensity. The continuous process of bubble multiplication, expansion and implosion lowers the cavitation threshold because cavitation bubbles grow from the vapor nuclei, whose volume is larger than that of the naturally present nuclei.

When fluid is subjected to the consecutive multi-stage cavitations it is heated up and becomes enriched with those nuclei. This lowers cavitation thresholds, intensifies processing and allows selective chemical reactions to occur while targeting compounds of interest. This makes the present device unique and especially suitable for treatment of multi-component viscous fluids such as, for example, petroleum, oil, melted animal fat, cell extracts and other feedstock of high economical value.

With sonic and ultrasonic radiation, the results are mixed unless cavitation is uniform throughout the liquid. However, creating uniform acoustic cavitation in large tanks, such as those used in commercial production, is particularly challenging.

The present device achieves alteration of fluids through use of a multi-stage flow-through hydrodynamic cavitation. The cavitation employed in accordance with the preferred embodiment of the present invention is achieved with a pump pressure selected from the range of approximately 50-5,000 psi. Therefore, a practical approach to the desired degree of upgrading is to establish a pressure that provides enough bubble implosion energy for mixing and upgrading. The optimal pressures produce cavities in sufficient quantities to achieve a high degree of treatment. However, as one skilled in the art understands, different fluids and mixtures require different energies obtained through cavitation in order for their alteration to occur. Any inlet pressure above 50 psi is sufficient to alter properties of fluids. Therefore, the range of 50-5,000 psi is in no way intended to limit the use of the present invention.

Energy released because of bubble implosion during a flow-through hydrodynamic cavitation process activates molecules forcing them to react and form entirely new compounds. The result is an upgraded product of higher commercial value whose components are easier to handle.

The flow-through hydrodynamic devices are designed to treat large volumes of fluid overall at ambient temperature and pressure. The cavitation process creates localized increases in temperature and pressure. Additional lines and skid systems can be added to scale up the production capacity.

These systems can be easily mounted and transported, making them suitable for production, blending, transportation and refining.

The beneficial effects gained through the present invention cannot be achieved through rotor-stator cavitation or sound- and ultrasound-induced cavitation because the conditions created in this process simply do not exist and cannot be duplicated by other means, including one- and two-stage cavitation. In a sound-induced process, cavitation bubbles form a barrier to transmission and attenuate the sound waves due to their scattering and diversion, limiting the effective distance. Furthermore, the ultrasonic irradiation modifies molecules at the specific locations within the liquid, depending on the frequency and the power of the source.

The present invention overcomes these limitations, chemically and physically changing the composition of fluid in uniform manner. This invention changes the molecular structures to a greater degree, reducing the size of molecules by supplying energy sufficient to drive radical reactions. Therefore, this invention provides a better means of upgrading and producing mixtures of superior homogeny.

The present invention uses energy released during the cavitation bubble implosion to alter fluids. The hydrodynamic cavitation is the phenomenon of the formation of vapor cavities in the flow of fluid, which is followed by the bubble collapse in a high pressure zone. In practice, the process is carried out as follows: the fluid flow is fed into the reactor's inlet passage. In the localized zone, the velocity accelerates causing the pressure in the flow to drop (Bernoulli's principle). This results in the formation of bubbles filled with the vapors of compounds that boil under the given conditions. When the cavitation bubbles move beyond the boundary of the tapered zone, the pressure in the flow increases and they collapse, exposing the vapors found within them to a high pressure and temperature, shearing force, shock waves, acoustic vibration and electromagnetic irradiation. Each cavitation bubble serves as an independent mini-reactor, in which chemical alterations are conducted. The developed pressure and the temperature are significantly higher than those in many other industrial processes. The further alteration of fluid composition results from the chemical reactions taking place within the collapsing bubbles or/and in the adjacent layers of fluid.

The present invention facilitates control of the intensity of the cavitation field by using the properly designed device and modulation of the inlet pressure. The high viscosity of viscous fluids can be lowered with pre-heating, adding solvents and surfactants, applying external electric or magnetic fields (Tao and Xu, 2006) or a combination thereof. Disintegration and fragmentation of large molecules further reduces the fluid viscosity.

The present invention creates beneficial conditions that cannot be duplicated. The process efficiency is enhanced by means of the multiple consequitive applications of cavitation processes creating regions of high pressure, elevated heat, turbulence and vigorous mixing in a short time period. The preferred embodiments of the present invention apply optimized levels of both pressure and temperature via the controlled flow-through hydrodynamic cavitation. The process is independent of external temperatures and pressure and provides a means of changing chemical composition, physical properties and other characteristics of fluids evenly throughout the fluid.

Important economic benefits are experienced also through implementation of the present invention. The optimized usage of a flow-through hydrodynamic multi-stage cavitation reactor serves to lower equipment, handling and energy costs, as it improves efficiency and scale of the treatment.

Certain detailed embodiments of the present invention are disclosed herein. However, it should be understood, that the disclosed embodiments are merely exemplary of the invention, which may be embodied in various forms. Various modifications may be made without departing from the scope and spirit of the invention. Accordingly, the invention is not to be limited, except as by the appended claims.

What is claimed is:

1. A method for processing a fluidic mixture in a multi-stage hydrodynamic cavitation device, comprising the steps of:

providing a flowpath through the hydrodynamic cavitation device;

pumping the fluidic mixture through a multi-jet nozzle having a plurality of channels, wherein the multi-jet nozzle creates cavitation features in the fluidic mixture;

passing the fluidic mixture over a plurality of spiral guides disposed in a working chamber, wherein the spiral guides create cavitation features in the fluidic mixture;

conveying the fluidic mixture over a plurality of flow guides in a vortex chamber, wherein the flow guides and vortex chamber create cavitational features in the fluidic mixture; and introducing the fluidic mixture to an atomizing cone which has an increasing cross-sectional area, wherein the fluidic mixture loses all cavitational features.

2. The method of claim 1, wherein the working chamber is bounded by an outer wall of a guide cone and an inner wall of a convergent cone arranged coaxially along the flowpath with the guide cone such that the working chamber has a decreasing diameter along the flowpath.

3. The method of claim 2, wherein the spiral guides are arranged about the outer wall of the guide cone and have a decreasing pitch following the decreasing diameter toward a peak of the guide cone.

4. The method of claim 1, wherein the multi-jet nozzle includes four channels, said channels having abrupt contractions and expansions along the flowpath.

5. The method of claim 1, wherein the multi-jet nozzle includes four channels, said channels being venturi-type channel comprised of a conical inlet having a round profile, a cylindrical throat and a conical outlet.

6. The method of claim 1, further comprising the step of processing the fluidic mixture multiple times by multiple passage through the multi-stage hydrodynamic cavitation device or passage through multiple multi-stage hydrodynamic cavitation devices arranged in series.

7. A multi-stage hydrodynamic cavitation device for processing a fluidic mixture, comprising:

a cylindrical housing having a flowpath therethrough and an inlet cone disposed in an inlet to the flowpath;

a multi-jet nozzle positioned in the flowpath after the inlet cone, the multi-jet nozzle having a plurality of channels disposed around a perimeter ring of the multi-jet nozzle;

a working chamber in the flowpath after the multi-jet nozzle, the working chamber having a generally annular-conical shape with a decreasing diameter along the flowpath;

a plurality of spiral guides disposed in the working chamber running from the channels on the multi-jet nozzle through the working chamber;

a vortex generator in the flowpath after the working chamber, the vortex generator comprised of a front disk, a rear disk and a cylinder body disposed therebetween, the front and rear disks including curved flow guides running from a central hole to an annular gap surrounding the cylinder body; and an atomizing cone in the flowpath after the vortex chamber.

8. The multi-stage hydrodynamic cavitation device of claim 7, wherein the multi-jet nozzle has four channels and each channel has an abrupt contraction and an abrupt expansion along the flowpath.

9. The multi-stage hydrodynamic cavitation device of claim 7, wherein the multi-jet nozzle has four channels and each channel is a venturi-type channel comprised of a conical inlet having a round profile, a cylindrical throat and a conical outlet.

10. The multi-stage hydrodynamic cavitation device of claim 7, wherein the generally annular-conical shape of the working chamber is defined by an outer wall of a guide cone and an inner wall of a convergent cone arranged coaxially along the flowpath with the guide cone.

11. The multi-stage hydrodynamic cavitation device of claim 10, wherein the spiral guides are arranged about the outer wall of the guide cone and have a decreasing pitch following the decreasing diameter toward a peak of the guide cone.

12. The multi-stage hydrodynamic cavitation device of claim 7, wherein the number of spiral guides equals the number of channels in the multi-jet nozzle.

* * * * *